US012435536B2

(12) United States Patent
Feck et al.

(10) Patent No.: US 12,435,536 B2
(45) Date of Patent: Oct. 7, 2025

(54) NON-CONDUCTIVE TENSIONED SAFETY BARRIER SYSTEM

(71) Applicants: Timothy Feck, Stuart, FL (US); Donald Coppedge, Stuart, FL (US); Ryan Coppedge, Stuart, FL (US)

(72) Inventors: Timothy Feck, Stuart, FL (US); Donald Coppedge, Stuart, FL (US); Ryan Coppedge, Stuart, FL (US)

(73) Assignee: ENTEX ENTERPRISES 44G, Stuart, FL (US)

( * ) Notice: Subject to any disclaimer, the term of this patent is extended or adjusted under 35 U.S.C. 154(b) by 381 days.

(21) Appl. No.: 18/169,903

(22) Filed: Feb. 16, 2023

(65) Prior Publication Data

US 2023/0258018 A1 Aug. 17, 2023

Related U.S. Application Data

(60) Provisional application No. 63/311,348, filed on Feb. 17, 2022.

(51) Int. Cl.
*E04H 17/18* (2006.01)
*E04H 17/00* (2006.01)
*E04H 17/16* (2006.01)

(52) U.S. Cl.
CPC ..... *E04H 17/168* (2013.01); *E04H 17/006* (2021.01); *E04H 17/013* (2021.01); *E04H 17/18* (2013.01)

(58) Field of Classification Search
CPC ..... E04H 4/06; E04H 17/168; E04H 17/18; E04H 17/006; E04H 17/013; E04H 17/161
See application file for complete search history.

(56) References Cited

U.S. PATENT DOCUMENTS 4,785,565 A * 11/1988 Kuffner ..... E04B 2/7427 40/605
5,794,990 A * 8/1998 Coppedge ..... E05B 65/0007 256/65.01

(Continued)

FOREIGN PATENT DOCUMENTS

| | | | | |
|---|---|---|---|---|
| EP | 1 132 549 | * | 9/2001 | ..... E04H 17/168 |
| EP | 2 055 866 | * | 5/2009 | ..... E04H 17/20 |
| FR | 2 785 933 | * | 5/2000 | ..... E04H 17/161 |

*Primary Examiner* — Michael P Ferguson

(57) ABSTRACT

A safety barrier system including a plurality of barrier assemblies, each barrier assembly having a barrier panel assembly including a rectangular barrier mesh supported by an upper edge binding member, a lower edge binding member, a pair of left stiffeners and a pair of right stiffeners wherein the pair of left stiffeners capture a left edge of the rectangular barrier mesh and the pair of right stiffeners capture a right edge of the rectangular barrier mesh. Each barrier assembly includes a barrier support pole having an upper pole end, a lower pole end opposite the upper pole end, the lower pole end engageable with a ground insert for allowing rotation of the barrier support pole and opposing first and second retention slots, each of the first and second retention slots extending from the upper pole end to the lower pole end, the first retention slot parallel to the second retention slot. Each barrier assembly includes a top cap for engaging the upper pole end and securing at least one of the pair of left stiffeners or the pair of right stiffeners in one of the first or second retention slot and a panel stop engaged with the first and second retention slot along a lower portion of the barrier support pole, the panel stop for supporting the lower edge binding member of the barrier panel assembly.

21 Claims, 9 Drawing Sheets

(56) References Cited

U.S. PATENT DOCUMENTS

| | | | | |
|---|---|---|---|---|
| 6,546,675 | B1 * | 4/2003 | Adderton | E04B 2/7435 52/282.1 |
| 7,234,688 | B1 * | 6/2007 | Asenbauer | E04H 4/06 256/65.01 |
| 10,604,962 | B1 * | 3/2020 | Givens | E04H 17/163 |
| 2005/0109998 | A1 * | 5/2005 | Sadinsky | E04H 4/06 256/25 |

* cited by examiner

NON-CONDUCTIVE TENSIONED SAFETY BARRIER SYSTEM

CROSS-REFERENCE TO RELATED APPLICATIONS

This application claims the benefit of U.S. Provisional Patent Application No. 63/311,348 filed on Feb. 17, 2022, which is incorporated by reference herein in its entirety."

COPYRIGHT STATEMENT

A portion of the disclosure of this patent document contains material that is subject to copyright protection. The copyright owner has no objection to the facsimile reproduction by anyone of the patent document or the patent disclosure as it appears in the Patent and Trademark Office patent file or records, but otherwise reserves all copyright rights whatsoever.

Trademarks used in the disclosure of the invention, and the applicants, make no claim to any trademarks referenced.

BACKGROUND OF THE INVENTION

Field of the Invention

The invention relates to barrier systems, fences, pool fences, pet fences, and the like and, more specifically relates to mesh pool fences.

Description of Related Art

As is currently used in the art, a continuous piece of mesh (typically 10-15' in length) is attached to a plurality of 1" cylindrical support tubes, typically hollow aluminum tubes. The mesh is attached to the face of the post with a ¾" wide aluminum molding strip affixed to the post along its length by a plurality of screws. This is a cumbersome way to affix mesh panels to posts, requiring numerous parts (screws and molding strips) and labor to affix over 100 screws to a post to assemble one 15' section of fencing. In addition, there are limited installation options in the field since the total length of individual sections were typically 15'. Due to the single length mesh panel (typically 10-15' in length) and plurality of posts screwed to the mesh, length customizations (shortening of the lengths) could only be accomplished to the 10-15' length fence sections at either end of the fence section without disturbing the post placement of interior support posts. Altering middle panel length would reveal numerous holes from the posts screwed to the mesh which would be unacceptable to the customer. This leads to unnecessary waste of materials and installation limitations. In addition, fence section length (making it longer) was limited to the original size (typically between 10' and 15' in length) and could not be extended without adding an additional 10-15' length of fencing.

The prior art, as it relates to gate frames, incorporated gate frames made of aluminum, typically welded into a rectangle, with a mesh panel affixed to the outside of the frame, again with a plurality of screws and molding strips to hold the mesh panel to the face of the frame. This required the welded or assembled gate frame be shipped in large boxes resulting in extensive shipping costs for a product part that only weighs 2-3 lbs. The prior art gate frame, being made from aluminum or steel, was subject to becoming bent and crooked in the field during usage common to interaction with young children and families. Crooked frames cause closing and latching misalignment failures unwelcome in child safety applications. Installation requires holes to be drilled into the patio surface (typically ⅝" to 1¼") at approximately 3' intervals to accept whatever fence support post was being used. The holes have no covering such that water, dust, and debris on the surface of the patio could wash into the holes over time and slowly sediment the posts into the holes making removal difficult if removal and cleaning was not frequent.

The prior art typically uses some version of aluminum tubing in the fabrication of the mesh fence support posts. A property of aluminum is its susceptibility to corrosion and becoming bent, crooked, or cracking off under pressures common to fencing.

The prior art uses primarily aluminum tubing in all or some portions of the final assembly. The National Electrical Code prevents insertion of any metal within 5' of the swimming pool edge thus limiting the placement capability of an aluminum support post fence within that distance.

SUMMARY OF THE INVENTION

A first implementation of the safety barrier system provides:

- a more attractive mesh pool fence barrier without the need for screws and molding strips using a hidden mesh fastening system to attached mesh to post.
- a fence section that is faster and easier to assemble in both the factory and field with fewer parts required to do so.
- a fence section that is easier to adjust in length in the field anywhere along its length.
- a fence section that is stronger due to stronger support posts and a superior post to mesh fastening system utilizing 100% post to mesh capture vs screws and molding strips.
- a barrier system which is non-conductive thus not requiring electrical bonding within 5' of the swimming pool as per the National Electrical Code,
- a gate frame that is collapsible and easily field assembled without the need of multiple screws and molding strips—again with 100% mesh to frame member capture.
- a barrier system which provides a completely modular system of short (typically 3' in length) individual mesh panels that each attach individually to their unique support posts. This allows for infinite customization in the field and rapid assembly in the factory without the need for screws and molding strips.

The safety barrier system incorporates a mesh stop or fence "skirt" (called a "support pole panel stop" in the provisional patent) at the bottom of the post that covers the hole and deck sleeve and prevents dirt and debris from entering the hole.

The present invention makes it faster and easier to manufacture the mesh pool fence barrier and gate frame and makes it more customizable in the field. It produces a stronger and more reliable mesh pool fence and gate frame. It also saves greatly on storage and shipping costs due to the collapsible gate frames. The fence is preferably 100% composite and non-conductive allows for more options of fence placement on the pool patio.

The above and other objects, which will be apparent to those skilled in the art, are achieved in the present invention which is directed to a safety barrier system including a plurality of barrier assemblies, each barrier assembly having a barrier panel assembly including a rectangular barrier panel supported by an upper edge binding member, a lower edge binding member, a pair of left side stiffeners and a pair of right side stiffeners wherein the pair of left side stiffeners capture a left edge of the rectangular barrier panel and the pair of right side stiffeners capture a right edge of the rectangular barrier panel. The barrier panel is preferably a barrier mesh panel. Each barrier assembly includes a barrier support pole having an upper pole end, a lower pole end opposite the upper pole end, the lower pole end engageable with a ground insert for allowing rotation of the barrier support pole and opposing first and second retention slots, each of the first and second retention slots extending from the upper pole end to the lower pole end, the first retention slot parallel to the second retention slot. Each barrier assembly includes a top cap for engaging the upper pole end and securing at least one of the pair of left side stiffeners or the pair of right side stiffeners in one of the first or second retention slot and a panel stop engaged with the first and second retention slot along a lower portion of the barrier support pole, the panel stop for supporting the lower edge binding member of the barrier panel assembly.

The safety barrier system may include at least one gate assembly having a gate frame assembly. The gate frame assembly includes a gate panel assembly, four frame corners, a frame top, a frame bottom and two frame sides and two support truss assemblies wherein edge bindings are folded allowing the frame top and frame side to slide onto the gate panel assembly. The frame corner are attached to the frame top and frame side by inserting mounting screws thru the corner mounting apertures and fastening into the frame top and frame side mounting apertures and repeated at each corner to complete a gate frame assembly wherein the gate frame attached to the left truss assembly by upper and lower hinges and the gate frame is attached to the right truss assembly by a latching mechanism.

The safety barrier system may include an installation guide for guiding the pair or left side stiffeners or the pair of right stiffeners into the corresponding first or second retention slot. The installation guide comprises a first guide opening and a second guide opening, each of the first and second guide openings extending from one end of the installation guide to the opposite end of the installation guide. The installation guide includes an upper portion having opposing first and second tapered slots and a lower portion having a cavity, cavity walls and a cavity upper surface, the cavity engageable with the upper pole end wherein the upper pole end contacts the cavity upper surface when the installation guide is engaged with the upper pole end. The safety barrier system may include at least one post tie for securing two adjacent barrier support poles of the plurality of barrier support poles. The post tie includes a first slot key and a second slot key, the first and second slot keys engageable with the opposing first and second retention slots. The post tie includes a first securing tab securable to one of the first or second retention slots and a second securing tab securable to the other of the first or second retention slots. The post tie includes tie openings disposed in the first and second securing tabs for securing the post tie to the two adjacent barrier support poles.

The barrier support pole may be rotatably engaged with a support pole insert secured in the ground or support surface whereby the position of adjacent barrier panel assemblies determines a rotational position of the barrier support pole. The safety barrier system may be a pool fence. The safety barrier system may be a pet fence. The safety barrier system may be a barrier for a patio, garage or yard.

The safety barrier system may include flexible post ties including a cable having opposing cable ends attached to one another to form a loop which is extendable around a pair of adjacent barrier support poles. The flexible post tie may be a steel cable having a plastic coating along the length of the cable and secures one barrier support pole to an adjacent barrier support pole. The opposing cable ends are attached with a crimp sleeve or other fastener. Crimping is preferably performed during manufacturing of the flexible post tie, but may be also crimped during in house assembly of the fence package to be installed. Generally, installer would carry extra flexible post ties for replacement if one is damaged during installation or in use and therefore would not need to crimp a flexible post tie in the field. For installation, an installer flexes the adjacent barrier support poles toward one another until the flexible post tie can be placed around the upper portions of the adjacent barrier support poles. The flexible post tie may directly secure the adjacent barrier support poles by wrapping around a portion of an upper end of the poles. Alternately, the flexible post tie may wrap around the adjacent key slots of the corresponding adjacent barrier support pole top caps wherein the barrier support pole top caps fit on top of the barrier support poles.

The flexible post tie extends around the top portion of adjacent barrier support poles and pass through post cap grooves which allow proper placement to the post caps once the flexible post tie is installed. The post caps secure the flexible post tie to the corresponding barrier support pole so sudden or aggressive movement of the rectangular barrier or mesh or other components will not disengage the flexible post tie from the adjacent barrier supports. The flexible post tie would preclude the need for a two piece latching mechanism currently available and provide a secure connection between fence sections.

BRIEF DESCRIPTION OF DRAWINGS

A further understanding of the nature and advantages of particular embodiments may be realized by reference to the remaining portions of the specification and the drawings, in which like reference numerals are used to refer to similar components. When reference is made to a reference numeral without specification to an existing sub-label, it is intended to refer to all such multiple similar components.

DETAILED DESCRIPTION OF THE INVENTION

Figure 1:
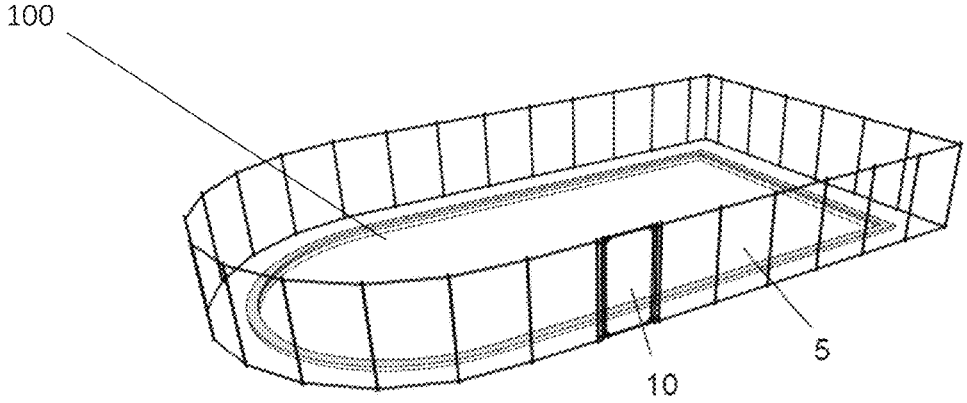
FIG. 1 is a perspective view of the safety barrier system according to the present invention.

While various aspects and features of certain embodiments have been summarized above, the following detailed description illustrates a few exemplary embodiments in further detail to enable one skilled in the art to practice such embodiments. The described examples are provided for illustrative purposes and are not intended to limit the scope of the invention.

In the following description, for the purposes of explanation, numerous specific details are set forth in order to provide a thorough understanding of the described embodiments. It will be apparent to one skilled in the art however that other embodiments of the present invention may be practiced without some of these specific details. Several embodiments are described herein, and while various features are ascribed to different embodiments, it should be appreciated that the features described with respect to one embodiment may be incorporated with other embodiments as well. By the same token however, no single feature or features of any described embodiment should be considered essential to every embodiment of the invention, as other embodiments of the invention may omit such features.

In this application the use of the singular includes the plural unless specifically stated otherwise and use of the terms "and" and "or" is equivalent to the use of "and/or," also referred to as "non-exclusive or" unless otherwise indicated. Moreover, the use of the term "including," as well as other forms, such as "includes" and "included," should be considered non-exclusive. Also, terms such as "element" or "component" encompass both elements and components including one unit and elements and components that include more than one unit, unless specifically stated otherwise.

Lastly, the terms "or" and "and/or" as used herein are to be interpreted as inclusive or meaning any one or any combination. Therefore, "A, B or C" or "A, B and/or C" mean "any of the following: A; B; C; A and B; A and C; B and C; A, B and C." An exception to this definition will occur only when a combination of elements, functions, steps or acts are in some way inherently mutually exclusive.

As this invention is susceptible to embodiments of many different forms, it is intended that the present disclosure be considered as an example of the principles of the invention and not intended to limit the invention to the specific embodiments shown and described.

The barrier panel 4A and the gate panel are preferably a mesh or mesh netting although an alternate material may be used as described herein. In any case, it is preferred that the barrier panel 4A and the gate panel are constructed using the same material for uniformity in installation and in aesthetics.

A gate frame utilizes the same post or pole configuration as the support posts to enable easy "slide-in" rectangular barrier assembly, preferably a mesh assembly, in the factory without screws and molding strips. It can be shipped in a partially unassembled state which does not require a large box thus greatly reducing shipping costs.

Referring now to FIGS. 1-29, and more particularly to FIG. 1, the drawings show a perspective view of the safety barrier system with a plurality of barrier assemblies 5 and a single gate assembly 10 installed around a swimming pool 100 in accordance with this invention.

Figure 2:
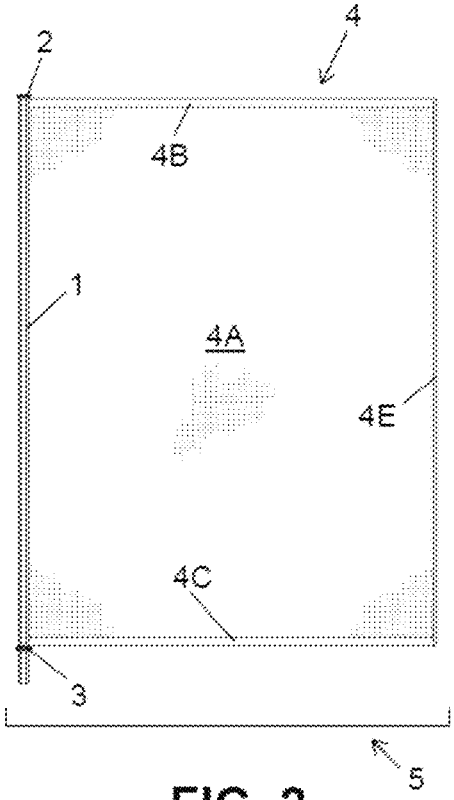
FIG. 2 is a front elevational view of a barrier section assembly for use in the safety barrier system shown in FIG. 1.
Figure 11:
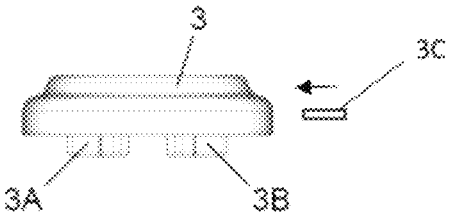
FIG. 11 is a front elevational view of the panel stop shown in FIG. 10.
Figure 12:
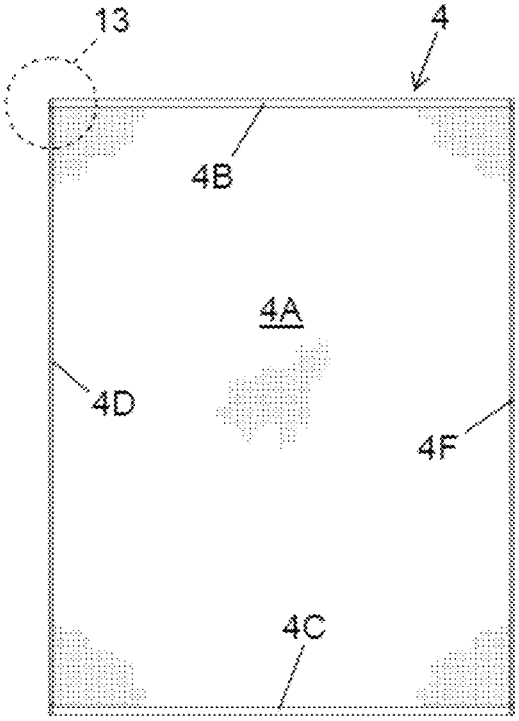
FIG. 12 is a front elevational view of a barrier panel assembly.

FIG. 2 is a front elevation view of a barrier assembly 5 consisting of a panel support pole 1, a support pole top cap 2 (FIGS. 5, 6 and 7), a support pole panel stop 3 (FIGS. 10 and 11) and a barrier panel assembly 4 (FIG. 12).

Figure 3:
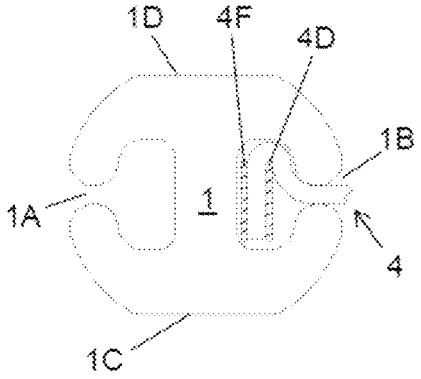
FIG. 3 is a top end view of a barrier support pole engaged with a portion of the barrier panel assembly shown in FIG. 2.

FIG. 3 is an end view of a barrier support pole 1 with a fragmentary portion of a barrier panel assembly 4 (FIG. 12) installed according to this invention. Retention slots 1A and 1B located on opposing sides of the barrier support pole 1 provide for the secure mounting and alignment of barrier panel assemblies 4, top caps 2, panel stops 3 and post ties 7. Mounting faces 1C and 1D provide a flat surface for fastening hardware such as top caps 2, post ties 7 and gate hinges and latches (not shown). The support pole may be composite, PVC, polycarbonate, polypropylene, fiberglass reinforced or non-reinforced polyurethane resin, acrylic plastic, Polymethyl Methacrylate plastic or any other semi-rigid material.

Figure 4:
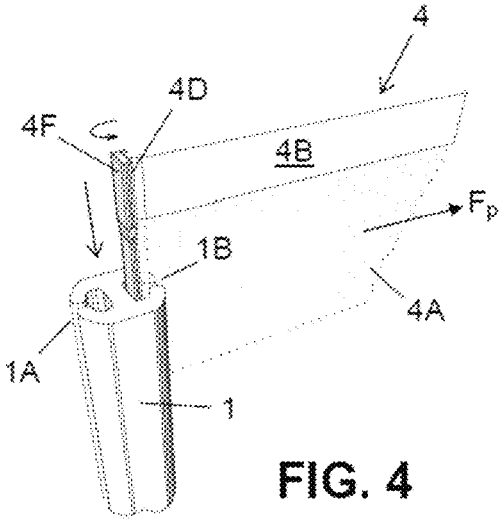
FIG. 4 is a fragmentary perspective view of the barrier panel assembly being inserted into a groove in the barrier support pole.

FIG. 4 is a fragmentary perspective view of a barrier support pole 1 with a barrier panel assembly 4 partially installed in the support pole retention slot 1B. Both retention slots 1A and 1B run the entire length of the barrier support pole 1 allowing simpler manufacturing of the barrier support pole 1 and allowing installation with either pole end inserted in the ground or support surface. The shape and size of retention slots 1A and 1B are such that the barrier panel assembly 4 must be folded to be properly installed and once installed a force exerted perpendicular Fp with respect to the barrier support pole 1 cannot pull the barrier panel assembly 4 free from the barrier support pole 1.

Figure 5:
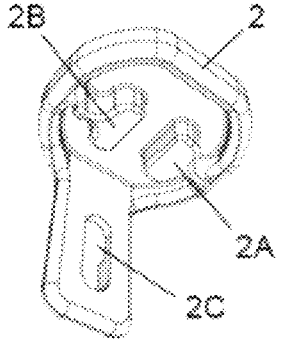
FIG. 5 is a bottom perspective view of a barrier support pole top cap.

FIG. 5 is a bottom perspective view of a barrier support pole top cap 2. Slot keys 2A and 2B provide a slip fit clearance into retention slots 1A and 1B (FIG. 3) of a barrier support pole 1. The slotted mounting aperture 2C allows for fastening the top cap 2 to either mounting face 1C or 1D of a barrier support pole 1. The preferred construction for the top cap 2 is a thermoplastic material providing good strength, durability and weather ability.

Figure 6:
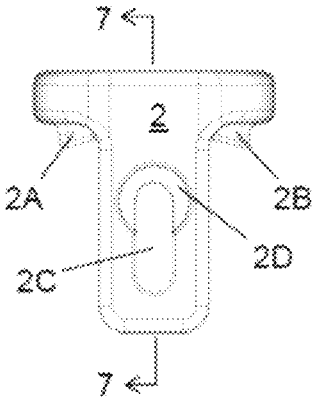
FIG. 6 is a rear elevational view of the barrier support pole top cap shown in FIG. 5.

FIG. 6 is a rear view of a barrier support pole top cap 2. Attachment of a top cap 2 to a barrier support pole 1 is accomplished by fully inserting slot keys 2A and 2B into retention slots 1A and 1B of a barrier support pole 1, a mounting screw 2E is then fastened through the upper end of the mounting aperture 2C into the barrier support pole 1 and tightened until seated inside the holding detent 2D. An attached top cap 2 prevents an installed barrier panel assembly 4 from being removed from the top of a barrier support pole 1.

Figure 7:
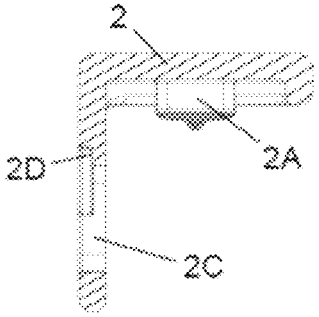
FIG. 7 is a sectional view of the barrier support pole top cap shown in FIG. 6 along cut lines 7-7.

FIG. 7 is a sectional view of FIG. 6 showing more detail of the mounting aperture 2C and the holding detent 2D.

Figure 8:
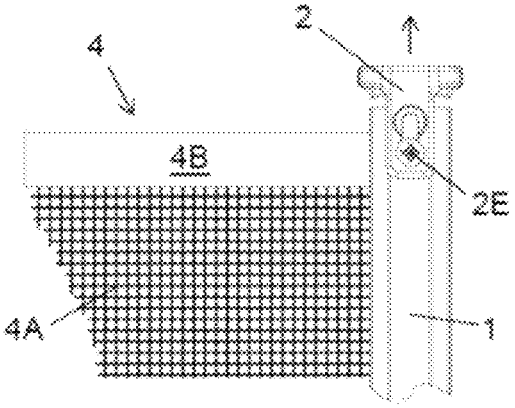
FIG. 8 is a partial rear view of the barrier panel system showing one step of a method for panel removal.

FIG. 8 is a partial rear view of a barrier panel assembly 4 installed as per invention in a barrier support pole 1 with the top cap mounting screw 2E loosened allowing the top cap 2 to be slid into the extended position.

Figure 9:
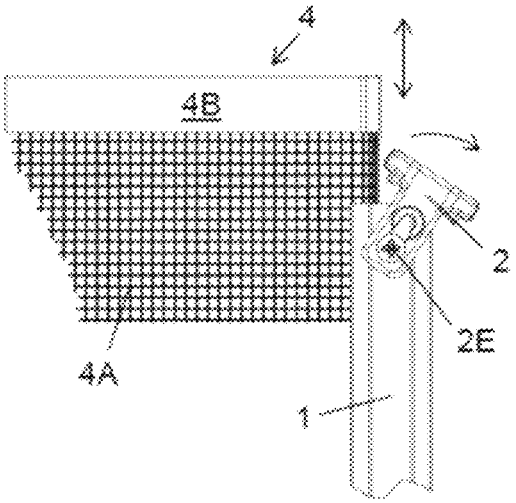
FIG. 9 is a partial rear view of the barrier panel system showing another step of a method for panel removal.

FIG. 9 is the same partial rear view as FIG. 8 showing the top cap 2 in the rotated position allowing a barrier panel assembly 4 to be either removed or installed as per invention.

Figure 10:
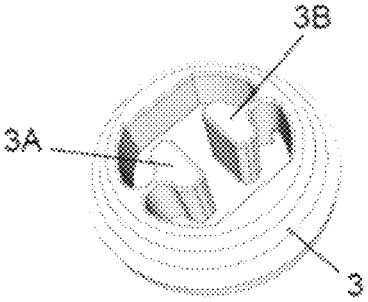
FIG. 10 is a top perspective view of a panel stop.

FIG. 10 is a top perspective view of a panel stop 3. The design of slot keys 3A and 3B provide a fixed fit clearance requiring moderate force to slide a panel stop 3 on and off of a barrier support pole 1. The preferred construction material for the panel stop 3 is a TPU (thermoplastic urethane) with a Shore A hardness ranging from 75 to 85 providing good surface friction, durability and weather ability.

FIG. 11 is a front view of a panel stop 3 showing the extended length required for slot keys 3A and 3B to produce a fixed fit clearance between the panel stop 3 and a barrier support pole 1. The panel stop 3 may additionally include a set screw 3C extendable through a set screw opening in the panel stop 3. The set screw 3C may include male threads engageable with female threads in the set screw opening so the set screw may be rotated to engage or disengage the barrier pole. The set screw secures the panel stop to the barrier pole in the desired location. The set screw is not necessary if the panel stop fits tightly against the barrier support pole 1.

Figure 29:
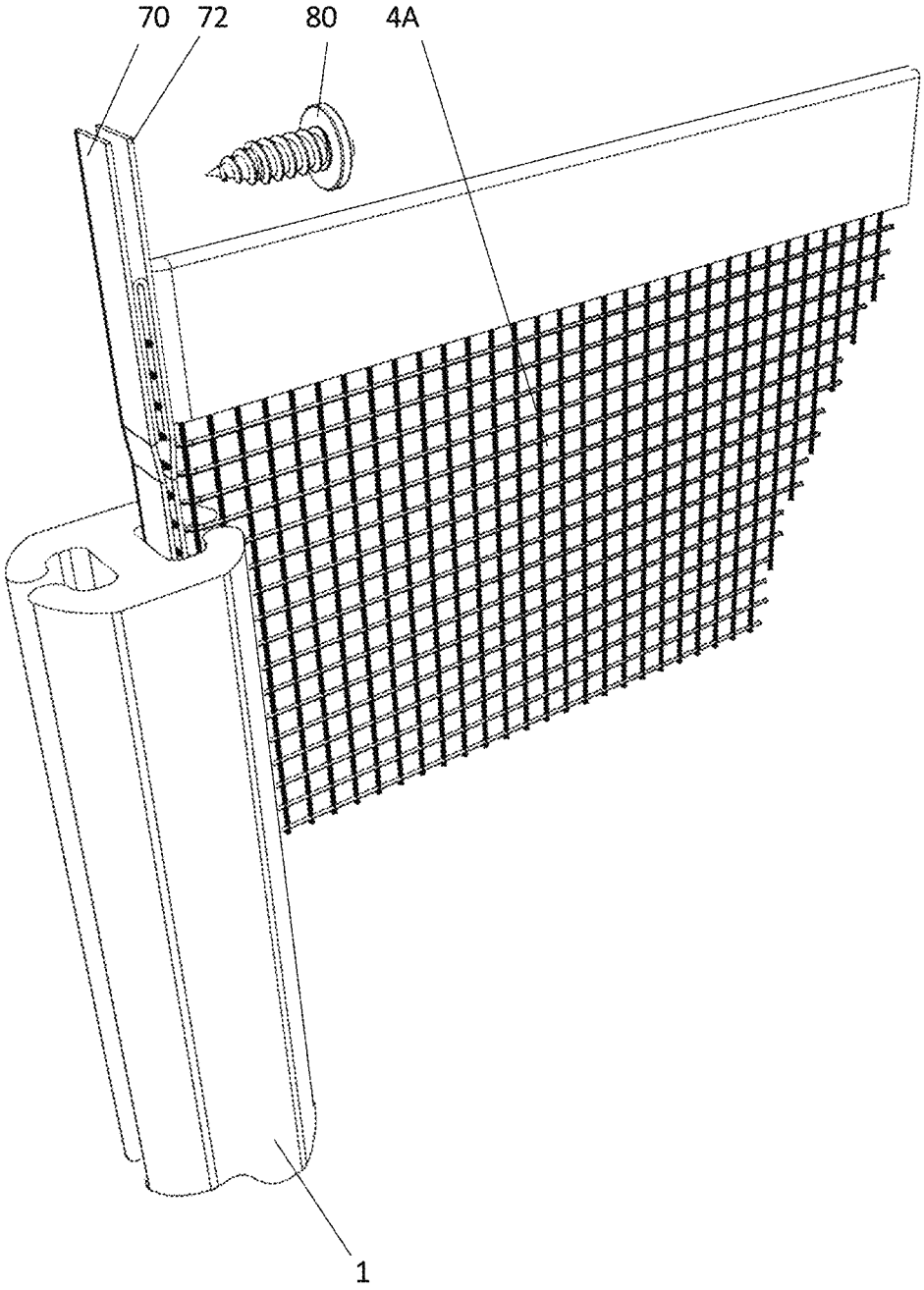
FIG. 29 is a partial perspective view of an alternate embodiment of the stiffener having a stiffener extension.

FIG. 12 is a front view of a barrier panel assembly 4 consisting of barrier panel 4A, an upper edge binding member 4B, a lower edge binding member 4C, left stiffeners 4D and 4E and right stiffeners 4F and 4G. Stiffeners 4E and 4G are not shown as they are located on the backside of the rectangular barrier panel 4A which is preferably a rectangular barrier mesh. The rectangular barrier panel 4A may be Eisenglass or other clear plastic, printed fabric, or other material that the barrier support pole can support. Once the barrier panel 4A has been cut to size the upper and lower edge bindings 4B and 4C are attached (either sewn or ultrasonically welded) covering the unfinished edge of the barrier panel 4A, as well as providing strength minimizing stretching of the barrier panel 4A at the top and bottom. The side stiffeners 4D, 4E, 4F and 4G are then attached (either by sewing, adhesive or ultrasonic welding) as per FIG. 13 providing the rigidity needed for installation into retention slots 1A and 1B of a barrier support pole 1. In a preferred embodiment as shown in FIG. 29, extended stiffeners 70, 72 are attached to the barrier panel at top and bottom (bottom not shown) with fasteners 80 which allows the barrier panel to be screwed through the T-slot into the stiffener to secure the barrier panel to the post to prevent any downward or upward force from sliding the mesh panel within the slot. The extended stiffeners may have a wider width than the stiffeners shown in the drawings and described in the specification.

Figure 13:
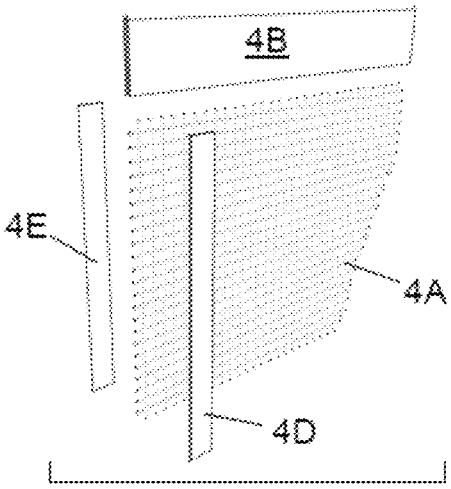
FIG. 13 is an exploded perspective partial construction view of the barrier panel assembly shown in FIG. 12.

FIG. 13 is an exploded partial construction view of the upper left corner of the barrier panel assembly 4.

Figure 14:
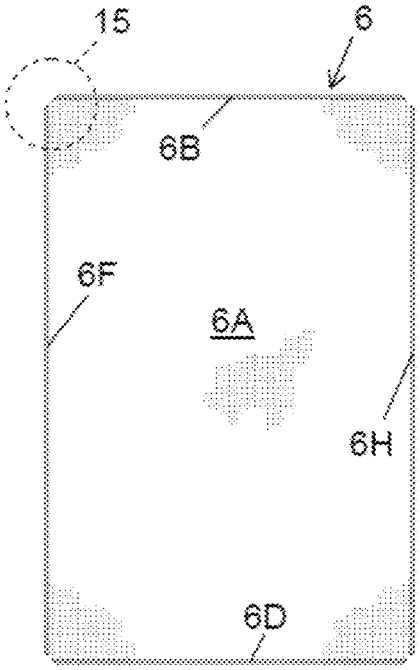
FIG. 14 is a front view of the gate panel assembly according to the present invention.
Figure 15:
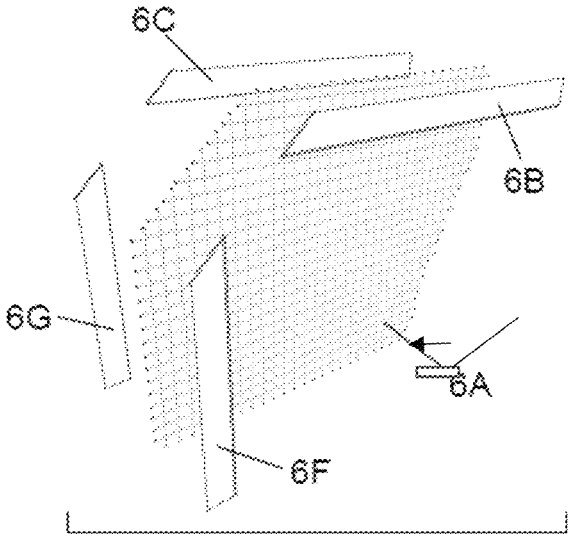
FIG. 15 is an exploded perspective partial construction view of the gate panel assembly shown in FIG. 14.

FIG. 14 is a front view of a gate panel assembly 6 consisting of gate mesh 6A, upper edge stiffeners 6B and 6C, lower edge stiffeners 6D and 6E, left stiffeners 6F and 6G and right stiffeners 6H and 61. Stiffeners 6C, 6E, 6G and 61 are not shown as they are located on the backside of the gate mesh 6A (see FIG. 15). Once the gate mesh 6A has been cut to size, the side stiffeners 6B, 6C, 6D, 6E, 6F, 6G, 6H and 61 are then attached (either by sewing, adhesive or ultrasonic welding) as per FIG. 15 providing the rigidity needed for installation into gate frame posts.

Referring now to FIGS. 12 thru 15 the following preferred construction materials apply. Barrier panel 4A and gate mesh 6A are an open weave, moisture and mildew resistant vinyl coated polyester mesh. Edge bindings 4B and 4C are moisture and mildew resistant vinyl coated polyester scrim and all edge stiffeners 4D, 4E, 4F, 4G, 6B, 6C, 6D, 6E, 6F, 6G, 6H and 61 are a moisture and mildew resistant thermoplastic copolymer. The gate mesh 6A may alternately be a gate panel matching any material used for the barrier panel 4A.

Figure 16:
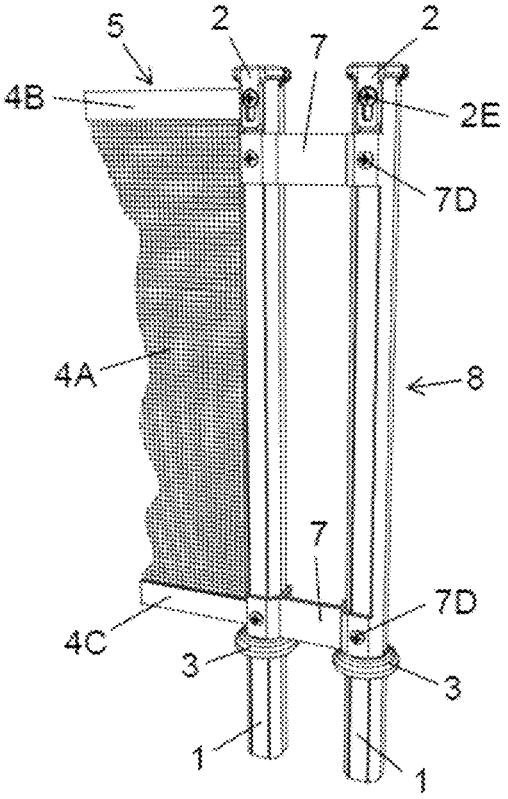
FIG. 16 is a perspective view of a truss assembly according to the present invention.

FIG. 16 is a partial perspective view of a truss assembly 8 attached to a barrier assembly 5.

Figure 17:
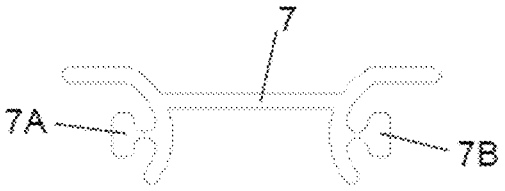
FIG. 17 is a top plan view of a post tie used in a support truss according to the present invention.

FIG. 17 is a top view of a post tie 7 used in a support truss 8. Slot keys 7A and 7B slide into the retention slots 1A and 1B of adjacent barrier support poles 1 to prevent pole rotation and provide proper alignment and spacing.

Figure 18:
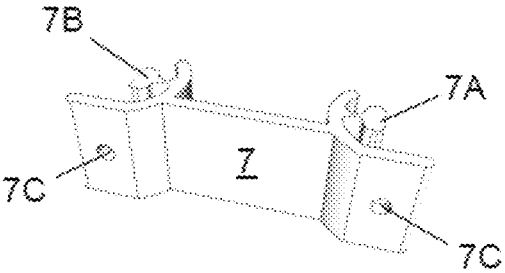
FIG. 18 is a rear perspective view of a post tie showing the mounting apertures located on the post tie.

FIG. 18 is a perspective view from the back of a post tie 7 showing the mounting aperture 7C, located on both sides of the post tie 7, used for attachment of the post tie 7 to the adjacent barrier support poles 1. The preferred construction for a post tie 7 is a thermoplastic material providing good strength, durability and weather ability.

Figure 19:
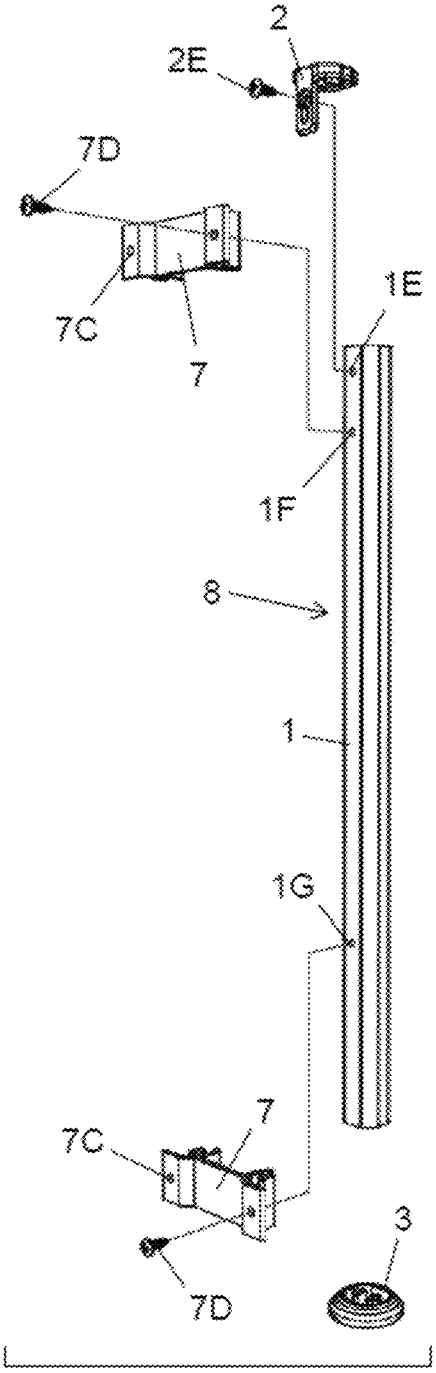
FIG. 19 is an explode perspective view of the support truss.

FIG. 19 is an explode perspective view of a support truss 8 consisting of a barrier support pole 1, two post ties 7, a panel stop 3 and a top cap 2. The upper and lower post ties 7 are attached by sliding slot keys 7A into retention slot 1A (not shown see FIG. 3), inserting mounting screws 7D thru mounting apertures 7C and fastening to barrier support pole apertures 1F and 1G. The panel stop 3 is slipped onto the bottom of the barrier support pole 1 and the top cap 2 is installed (see description details of FIG. 6) on the top of the barrier support pole 1.

Figure 20:
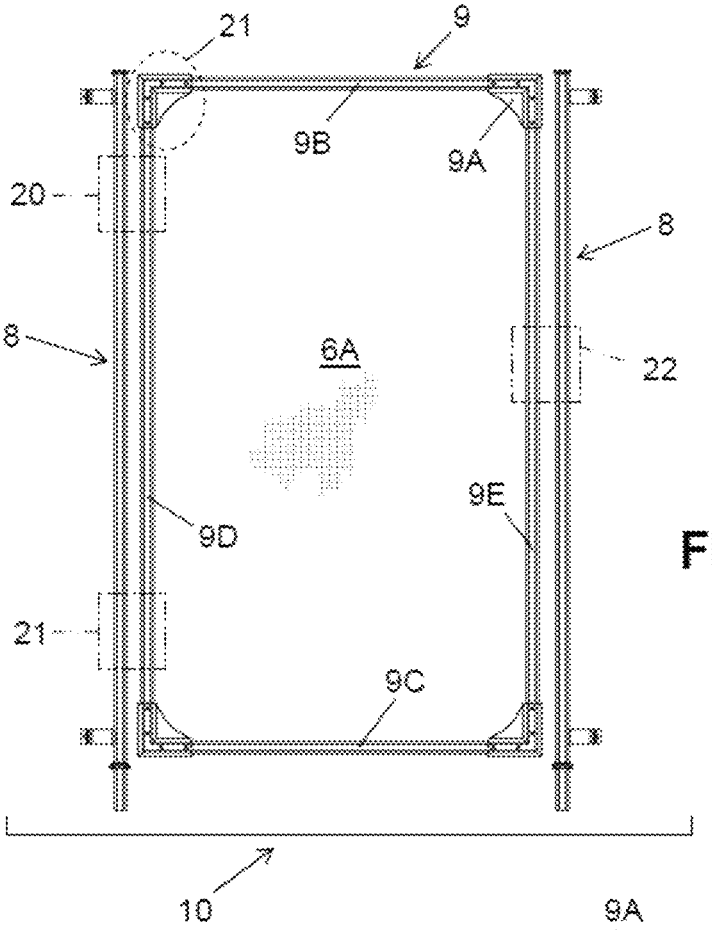
FIG. 20 is a front elevational view of a gate assembly according to the present invention.

FIG. 20 is a front view of a gate assembly 10 consisting of gate frame assembly 9 and two support truss assemblies 8. The gate frame assembly 9 consists of a gate panel assembly 6A, four frame corners 9A, a frame top 9B, a frame bottom 9C and two frame sides 9D and 9E. The gate frame may be attached to the truss assembly by upper and lower hinges in locations 20 and 21. The gate frame may be attached to the truss assembly by a latch. The gate frame assembly may not be required in some installations.

Figure 21:
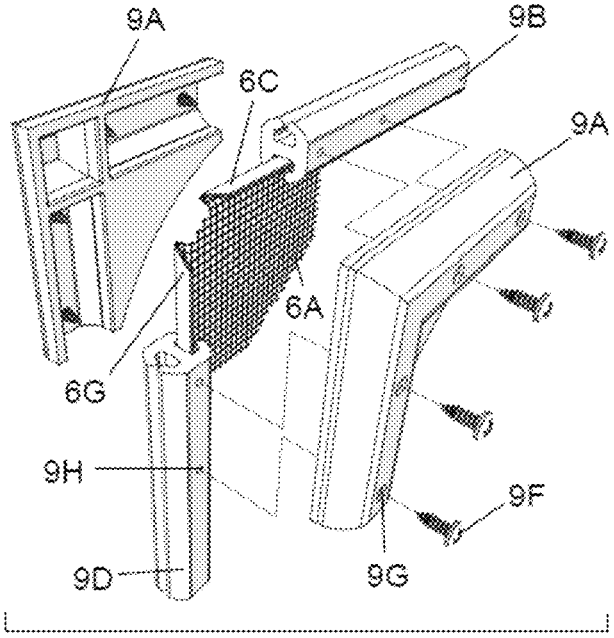
FIG. 21 is an exploded perspective view of the upper left corner of a gate frame assembly according to the present invention.
Figure 22:
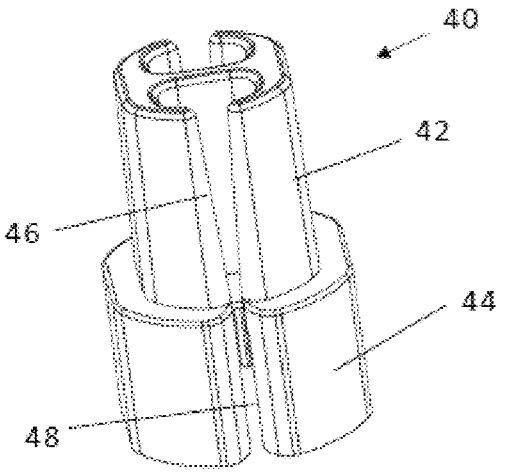
FIG. 22 is a top left side perspective view of the installation guide according to the present invention.
Figure 23:
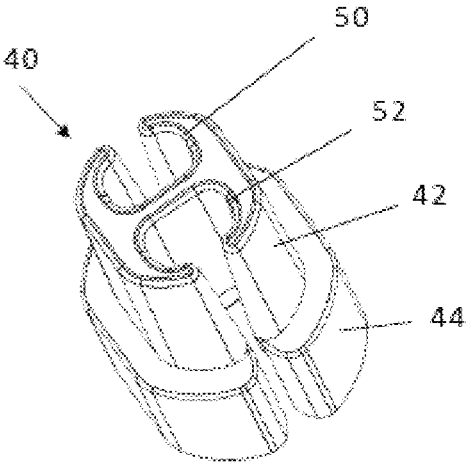
FIG. 23 is a top front right side perspective view of the installation guide shown in FIG. 22.
Figure 24:
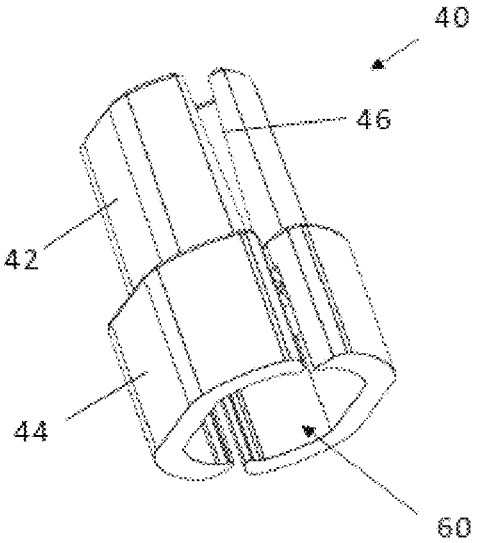
FIG. 24 is a bottom front right side perspective view of the installation guide shown in FIG. 22.
Figure 25:
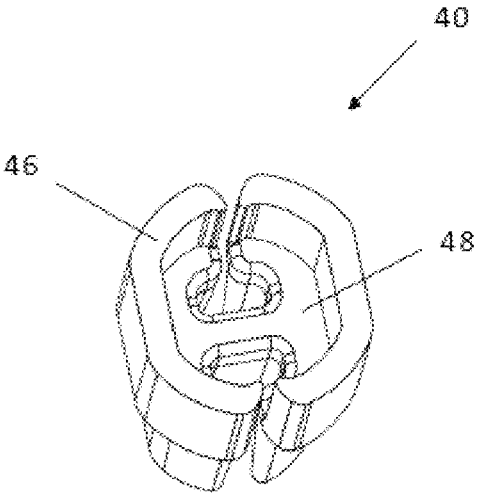
FIG. 25 shows the cavity of the installation guide shown in FIG. 22.
Figure 26:
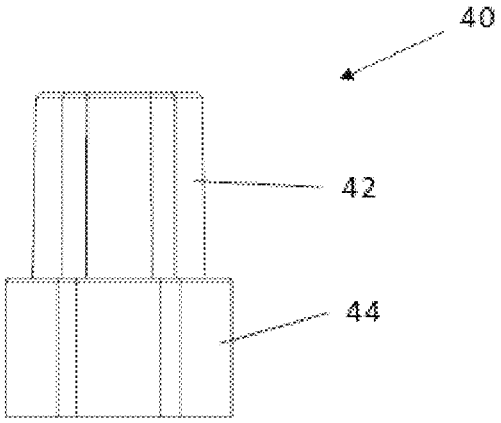
FIG. 26 is a front elevational view of the installation guide shown in FIG. 22.

FIG. 21 is an exploded perspective view of the upper left corner of the gate frame assembly 9. The edge bindings 6C and 6G are folded allowing the frame top 9B and frame side 9D to slide onto the gate panel assembly 6A. The two-part gate corner 9A is attached to the frame top 9B and frame side 9D by inserting the 8 mounting screws 9F thru the corner mounting apertures 9G and fastening into the frame top 9B and frame side 9D mounting apertures 9H. This process is repeated at each corner to complete a gate frame assembly 9.

In operation the installer determines how many barrier sections 5, truss assemblies 8 and gate sections 10 will be needed for the application and either drill holes or set posts as required by the surface construction (The typical spacing between barrier section support poles 1 is 36 inches with smaller spacing as required for custom barrier sections and trusses 8). The support poles of the barrier sections 5, gate sections 10 and truss assemblies 8 are inserted into the drilled holes or set posts until the area to be protected is surrounded. All truss assemblies 8 and gate sections 10 are then attached to their adjacent barrier sections either by post ties 7 or adjustable latches (not shown) to provide the proper tension.

Another embodiment of the present invention is a safety barrier system as shown in FIGS. 1-28 of the drawings. The safety barrier system includes a plurality of barrier assemblies 5. Each barrier assembly 5 includes a barrier panel assembly 4 having a rectangular barrier which is preferably a rectangular barrier mesh 4A incorporating an upper edge binding member 4B, a lower edge binding member 4C, a pair of left stiffeners 4E, 4D and a pair of right stiffeners 4F, 4G. The pair of left stiffeners 4D, 4E capture a left edge of the rectangular barrier mesh 4A and the pair of right stiffeners 4F, 4G capture a right edge of the rectangular barrier mesh 4A. Each barrier assembly 5 includes a barrier support pole 1 having an upper pole end and a lower pole end opposite the upper pole end. The lower pole end is engageable with a ground insert for allowing rotation of the barrier support pole 1. The barrier support pole 1 includes opposing first and second retention slots 1A, 1B. Each of the first and second retention slots 1A, 1B extend from the upper pole end to the lower pole end with the first retention slot 1A being parallel to the second retention slot 1B. Each barrier assembly 5 includes a top cap 2 for engaging the upper pole end and securing at least one of the pair of left stiffeners or the pair of right stiffeners in one of the first or second retention slot 1A, 1B of barrier support pole 1. Each barrier assembly includes a panel stop engaged with the first and second retention slot along a lower portion of the barrier support pole. The panel stop 3 supports the lower edge binding member of the barrier panel assembly 4A.

The safety barrier system may include at least one gate assembly 10. The gate assembly includes a gate panel assembly, four frame corners, a frame top, a frame bottom and two frame sides and two support truss assemblies. The edge bindings are folded allowing the frame top and frame side to slide onto the gate panel assembly. The frame corners are attached to the frame top and frame side by inserting mounting screws through the corner mounting apertures and fastening into the frame top and frame side mounting apertures and repeated at each corner to complete a gate frame assembly wherein the gate frame is attached to one truss assembly by upper and lower hinges and the gate frame is attached to the opposing truss assembly by a latching mechanism.

The safety barrier system includes an installation guide 40 as shown in FIGS. 22-26 of the drawings. The installation guide 40 is provided as a tool for guiding the pair of left stiffeners or the pair of right stiffeners into the corresponding first or second retention slot of barrier support pole 1. The installation guide 40 comprises a first guide opening 50 and a second guide opening 52, each of the first and second guide openings extending from one end of the installation guide to the opposite end of the installation guide. The installation guide 40 includes an upper portion 42 having opposing first and second tapered slots and a lower portion 44 having a cavity 60, cavity wall 46 and a cavity upper surface 48, the cavity 60 engageable with the upper pole end wherein the upper pole end contacts the cavity upper surface 48 when the installation guide 40 is engaged with the upper pole end.

In operation, the installer places the installation guide 40 on top of an installed barrier support pole 1 after installing the panel stop 3 on the barrier support pole 1. The installer then engages the cavity wall 46 and cavity upper surface 48 with the upper end of the barrier support pole 1 so that openings 50, 52 align with the pole retention slots. The installer places the lower end of one of the stiffener pairs into the upper opening 50, 52 of the installation guide 40 and lowers the stiffener pair until the lower end contacts the panel stop. The installation guide 40 is then removed unless another pair of stiffeners is to be installed. The installation guide 40 must be removed in order to install a top cap on the barrier support pole.

The safety barrier system includes post ties 7 for securing two adjacent barrier support poles. The post tie 7 includes a first slot key and a second slot key. The first and second slot keys are engageable with the opposing first and second retention slots. The post tie 7 includes a first securing tab securable to one of the first or second retention slots and a second securing tab securable to the other of the first or second retention slots. The post tie 7 includes tie openings disposed in the first and second securing tabs for securing the post tie 7 to the two adjacent barrier support poles.

Figure 27:
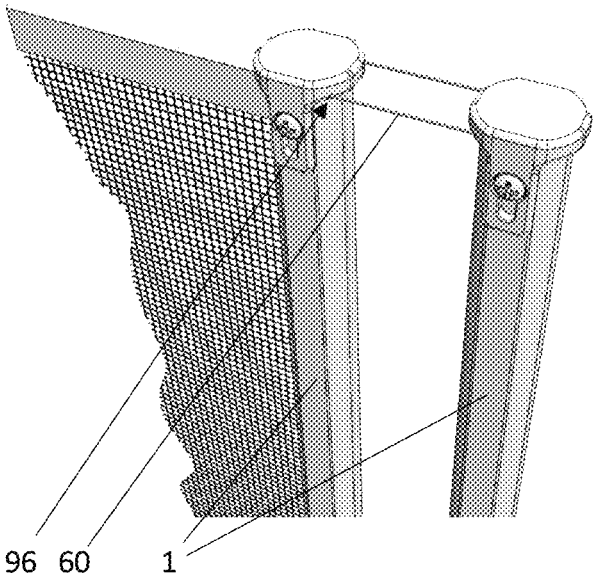
FIG. 27 is a partial perspective view of a pair of adjacent barrier support poles being secured to one another with a flexible post tie.
Figure 28:
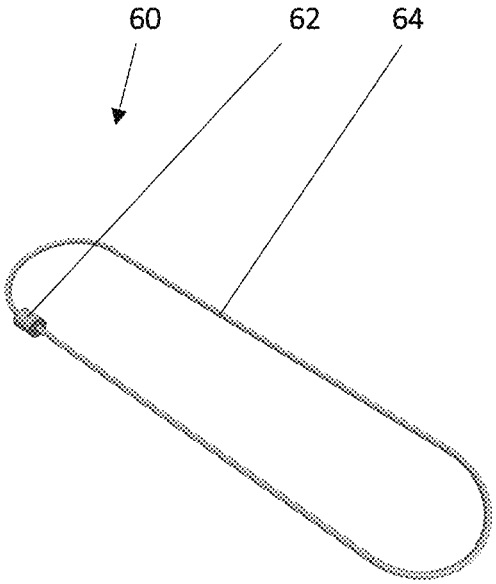
FIG. 28 is a perspective view of the flexible post tie shown in FIG. 27.

FIGS. 27 and 28 show another embodiment of a post tie. The flexible post tie 60 is a cable having opposing cable ends attached to one another to form a loop which is extendable around a pair of adjacent barrier support poles. The flexible post tie 60 is preferably a steel cable 60 having a plastic coating along the length of the cable and secures one barrier support pole to an adjacent barrier support pole. The opposing cable ends are attached with a crimp sleeve 52 or other fastener. Crimping is preferably performed during manufacturing of the flexible post tie 60 but may be also crimped during in house assembly of the fence package to be installed. Generally, installer would carry extra flexible post ties 60 for replacement if one is damaged during installation or in use and therefore would not need to crimp a flexible post tie in the field. For installation, an installer flexes the adjacent barrier support poles 1 toward one another until the flexible post tie 60 can be placed around the upper portions of the adjacent barrier support poles 1. The flexible post tie 60 may directly secure the adjacent barrier support poles 1 by wrapping around a portion of an upper end of the poles. Alternately, the flexible post tie 60 may wrap around the adjacent key slots 2A, 2B of the corresponding adjacent barrier support pole top caps 2 which support the adjacent barrier support poles 1.

The flexible post tie extends around the top portion of adjacent barrier support poles and may pass around and under post cap grooves 96, shown in FIG. 27, which allow proper placement to the post caps once the flexible post tie is installed. The post caps secure the flexible post tie to the corresponding barrier support pole so sudden or aggressive movement of the rectangular barrier which is preferably a rectangular barrier mesh (or mesh) or other components will not disengage the flexible post tie from the adjacent barrier supports.

When looped around the support post cap ends 2 (and within the cap itself) of two separate opposing sections, the flexible post tie 60 secures the end posts together. Both loops are fixed to the post under slot 2C on FIG. 5 and closer to the top of the post, with screw 2E securing the post cap to the pole, preventing the cable from being removed from the post or from slipping below the screw 2E. To unlatch, one would loosen the screw 2E which would allow the cap to rotate out of the way, squeeze the posts together slightly—such that you could release the loop—and unlatch the two sections. The flexible post tie also provides a manner of permanently attaching two sections of fence together—something occasionally required by code. Because it cannot be "unlatched" without removing the screw 2E to enable the loop to "unloop" from the post and from the top cap. Since removal of the flexible cable tie 60 requires a tool for removal of the fence, the definition of "permanence" for code purposes is met.

Figure 30:
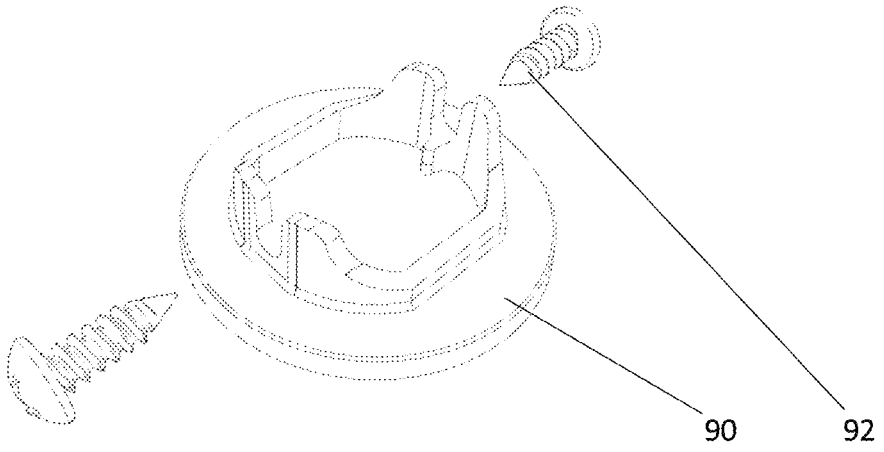
FIG. 30 is a top perspective view of an alternate embodiment of the panel stop according to the present invention.
Figure 31:
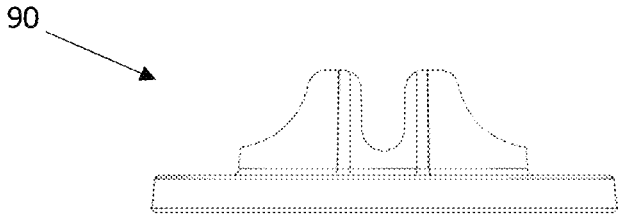
FIG. 31 is a side elevational view of the panel stop shown in FIG. 30.
Figure 32:
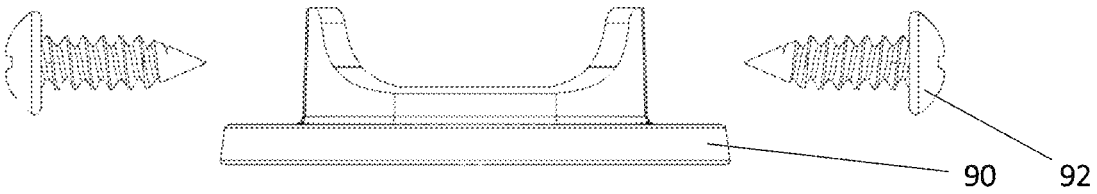
FIG. 32 is a front elevational view of the panel stop shown in FIG. 30.

FIGS. 30-32 show an alternate embodiment of the panel stop according to the present invention. The panel stop 90 is attached along a lower portion of the barrier support pole 1 using a pair of fasteners 92 to secure the panel stop 90 to the barrier support pole 1.

The barrier support pole is rotatable in relation to an engaged support pole insert secured in the ground or support surface whereby the position of adjacent barrier panel assemblies determines a rotational position of the barrier support pole. The safety barrier system may be a pool fence. The safety barrier system may be a pet fence. The safety barrier system may be a barrier for a patio, garage or yard.

Since many modifications, variations, and changes in detail can be made to the described embodiments of the invention, it is intended that all matters in the foregoing description and shown in the accompanying drawings be interpreted as illustrative and not in a limiting sense. Furthermore, it is understood that any of the features presented in the embodiments may be integrated into any of the other embodiments unless explicitly stated otherwise. The scope of the invention should be determined by the appended claims and their legal equivalents.

In addition, the present invention has been described with reference to embodiments, it should be noted and understood that various modifications and variations can be crafted by those skilled in the art without departing from the scope and spirit of the invention. Accordingly, the foregoing disclosure should be interpreted as illustrative only and is not to be interpreted in a limiting sense. Further it is intended that any other embodiments of the present invention that result from any changes in application or method of use or operation, method of manufacture, shape, size, or materials which are not specified within the detailed written description or illustrations contained herein are considered within the scope of the present invention.

Insofar as the description above and the accompanying drawings disclose any additional subject matter that is not within the scope of the claims below, the inventions are not dedicated to the public and the right to file one or more applications to claim such additional inventions is reserved.

Although very narrow claims are presented herein, it should be recognized that the scope of this invention is much broader than presented by the claim. It is intended that broader claims will be submitted in an application that claims the benefit of priority from this application.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

The invention claimed is:

1. A safety barrier system comprising:

a plurality of barrier assemblies, each barrier assembly including:

a barrier panel assembly having a rectangular barrier supported by an upper edge binding member, a lower edge binding member, a pair of left stiffeners and a pair of right stiffeners wherein the pair of left stiffeners capture a left edge of the rectangular barrier and the pair of right stiffeners capture a right edge of the rectangular barrier;

a barrier support pole including:

an upper pole end;

a lower pole end opposite the upper pole end, the lower pole end engageable with a ground insert for allowing rotation of the barrier support pole;

opposing first and second retention slots, each of the first and second retention slots extending from the upper pole end to the lower pole end, the first retention slot parallel to the second retention slot;

a top cap for engaging the upper pole end and securing at least one of the pair of left stiffeners or the pair of right stiffeners in one of the first or second retention slot; and a panel stop engaged with the first and second retention slot along a lower portion of the barrier support pole, the panel stop for supporting the lower edge binding member of the barrier panel assembly; and at least one gate assembly including:

a gate frame assembly having:

a gate panel assembly, four frame corners, a frame top, a frame bottom and two frame sides; and two support truss assemblies;

wherein edge bindings are folded allowing the frame top and each frame side to slide onto the gate panel assembly, a frame corner is attached to the frame top and each frame side by inserting mounting screws through corner mounting apertures and fastening into the frame top and frame side mounting apertures and repeated at each corner to complete a gate frame assembly, wherein the gate frame is attached to a left truss assembly by upper and lower hinges and the gate frame is attached to a right truss assembly by a latching mechanism, and wherein each truss assembly is secured to a respective barrier support pole of an adjacent barrier assembly.

2. The safety barrier system according to claim 1 including an installation guide for guiding the pair of left stiffeners or the pair of right stiffeners into the corresponding first or second retention slot, the installation guide comprising:

a first guide opening and a second guide opening, each of the first and second guide openings extending from one end of the installation guide to the opposite end of the installation guide;

an upper portion having opposing first and second tapered slots; and a lower portion having a cavity, cavity walls and a cavity upper surface, the cavity engageable with the upper pole end wherein the upper pole end contacts the cavity upper surface when the installation guide is engaged with the upper pole end.

3. The safety barrier system according to claim 1 including at least one post tie for securing two adjacent barrier support poles of the plurality of barrier support poles, the post tie comprising:

a first slot key and a second slot key, the first and second slot keys engageable with the opposing first and second retention slots;

a first securing tab securable to one of the first or second retention slots and a second securing tab securable to the other of the first or second retention slots; and tie openings disposed in the first and second securing tabs for securing the post tie to the two adjacent barrier support poles.

4. The safety barrier system according to claim 1 including at least one flexible post tie for securing two adjacent barrier support poles of the plurality of barrier support poles, the at least one flexible post tie comprising a cable having opposing cable ends attached to one another, the cable forming a loop wherein the at least one flexible post tie is engageable at an upper portion of the two adjacent barrier support poles.

5. The safety barrier system according to claim 4 wherein the opposing cable ends are attached with a crimp sleeve.

6. The safety barrier system according to claim 1 wherein the barrier support pole is rotatably engaged with a support pole insert secured in the ground or support surface whereby the position of adjacent barrier panel assemblies determines a rotational position of the barrier support pole.

7. The safety barrier system according to claim 1 wherein the safety barrier system is a pool fence.

8. The safety barrier system according to claim 1 wherein the safety barrier system is a pet fence.

9. The safety barrier system according to claim 1 wherein the safety barrier system is a barrier for a patio, garage or yard.

10. A safety barrier system comprising:

a plurality of barrier assemblies, each barrier assembly including:

a barrier panel assembly having a rectangular barrier supported by an upper edge binding member, a lower edge binding member, a pair of left stiffeners and a pair of right stiffeners wherein the pair of left stiffeners capture a left edge of the rectangular barrier and the pair of right stiffeners capture a right edge of the rectangular barrier;

a barrier support pole including:

an upper pole end;

a lower pole end opposite the upper pole end, the lower pole end engageable with a ground insert for allowing rotation of the barrier support pole;

opposing first and second retention slots, each of the first and second retention slots extending from the upper pole end to the lower pole end, the first retention slot parallel to the second retention slot;

a top cap for engaging the upper pole end and securing at least one of the pair of left stiffeners or the pair of right stiffeners in one of the first or second retention slot;

a panel stop engaged with the first and second retention slot along a lower portion of the barrier support pole, the panel stop for supporting the lower edge binding member of the barrier panel assembly; and at least one gate assembly including:

a gate frame assembly having:

a gate panel assembly, four frame corners, a frame top, a frame bottom and two frame sides; and two support truss assemblies;

wherein edge bindings are folded allowing the frame top and each frame side to slide onto the gate panel assembly, a frame corner is attached to the frame top and each frame side by inserting mounting screws through corner mounting apertures and fastening into the frame top and frame side mounting apertures and repeated at each corner to complete a gate frame assembly, wherein the gate frame is attached to a left truss assembly by upper and lower hinges and the gate frame is attached to a right truss assembly by a latching mechanism, and wherein each truss assembly is secured to a respective barrier support pole of an adjacent barrier assembly.

11. The safety barrier system according to claim 10 including an installation guide for guiding the pair of left stiffeners or the pair of right stiffeners into the corresponding first or second retention slot, the installation guide comprising:

a first guide opening and a second guide opening, each of the first and second guide openings extending from one end of the installation guide to the opposite end of the installation guide;

an upper portion having opposing first and second tapered slots; and a lower portion having a cavity, cavity walls and a cavity upper surface, the cavity engageable with the upper pole end wherein the upper pole end contacts the cavity upper surface when the installation guide is engaged with the upper pole end.

12. The safety barrier system according to claim 10 including at least one post tie for securing two adjacent barrier support poles of the plurality of barrier support poles, the post tie comprising:

a first slot key and a second slot key, the first and second slot keys engageable with the opposing first and second retention slots;

a first securing tab securable to one of the first or second retention slots and a second securing tab securable to the other of the first or second retention slots; and tie openings disposed in the first and second securing tabs for securing the post tie to the two adjacent barrier support poles.

13. The safety barrier system according to claim 10 wherein the barrier support pole is rotatably engaged with a support pole insert secured in the ground or support surface whereby the position of adjacent barrier panel assemblies determines a rotational position of the barrier support pole.

14. The safety barrier system according to claim 10 wherein the safety barrier system is a barrier for a patio, garage or yard.

15. The safety barrier system according to claim 10 wherein the safety barrier system is a pool fence.

16. The safety barrier system according to claim 10 wherein the safety barrier system is a pet fence.

17. A kit for installing a safety barrier system, the kit including:

a plurality of barrier assemblies, each barrier assembly including:

a rectangular barrier supported by an upper edge binding member, a lower edge binding member, a pair of left stiffeners and a pair of right stiffeners wherein the pair of left stiffeners capture a left edge of the rectangular barrier and the pair of right stiffeners capture a right edge of the rectangular barrier;

a barrier support pole having a length, the barrier support pole including an upper pole end and a lower pole end opposite the upper pole end, the lower pole end engageable with a ground insert for allowing rotation of the barrier support pole and opposing first and second retention slots extending from the length of the barrier support pole;

a top cap for engaging the upper pole end and securing at least one of the pair of left stiffeners or the pair of right stiffeners in one of the first or second retention slot;

a panel stop engaged with the first and second retention slot along a lower portion of the barrier support pole, the panel stop for supporting the lower edge binding member of the barrier panel assembly;

an installation guide for guiding the pair or left stiffeners or the pair of right stiffeners into the corresponding first or second retention slot; and at least one gate assembly including:

a gate frame assembly having:

a gate panel assembly, four frame corners, a frame top, a frame bottom and two frame sides; and two support truss assemblies;

wherein edge bindings are folded allowing the frame top and each frame side to slide onto the gate panel assembly, a frame corner is attached to the frame top and each frame side by inserting mounting screws through corner mounting apertures and fastening into the frame top and frame side mounting apertures and repeated at each corner to complete a gate frame assembly, wherein the gate frame is attached to a left truss assembly by upper and lower hinges and the gate frame is attached to a right truss assembly by a latching mechanism, and wherein each truss assembly is secured to a respective barrier support pole of an adjacent barrier assembly.

18. The kit according to claim 17 including at least one post tie for securing two adjacent barrier support poles of the plurality of barrier support poles, the post tie comprising:

a first slot key and a second slot key, the first and second slot keys engageable with the opposing first and second retention slots;

a first securing tab securable to one of the first or second retention slots and a second securing tab securable to the other of the first or second retention slots; and tie openings disposed in the first and second securing tabs for securing the post tie to the two adjacent barrier support poles.

19. A safety barrier system comprising:

a plurality of barrier assemblies, each barrier assembly including:

a barrier panel assembly having a rectangular barrier supported by an upper edge binding member, a lower edge binding member, a pair of left stiffeners and a pair of right stiffeners wherein the pair of left stiffeners capture a left edge of the rectangular barrier and the pair of right stiffeners capture a right edge of the rectangular barrier;

a barrier support pole including:

an upper pole end;

a lower pole end opposite the upper pole end, the lower pole end engageable with a ground insert for allowing rotation of the barrier support pole;

opposing first and second retention slots, each of the first and second retention slots extending from the upper pole end to the lower pole end, the first retention slot parallel to the second retention slot;

a top cap for engaging the upper pole end and securing at least one of the pair of left stiffeners or the pair of right stiffeners in one of the first or second retention slot;

a panel stop engaged with the first and second retention slot along a lower portion of the barrier support pole, the panel stop for supporting the lower edge binding member of the barrier panel assembly; and an installation guide for guiding the pair of left stiffeners or the pair of right stiffeners into the corresponding first or second retention slot, the installation guide comprising:

a first guide opening and a second guide opening, each of the first and second guide openings extending from one end of the installation guide to the opposite end of the installation guide;

an upper portion having opposing first and second tapered slots; and a lower portion having a cavity, cavity walls and a cavity upper surface, the cavity engageable with the upper pole end wherein the upper pole end contacts the cavity upper surface when the installation guide is engaged with the upper pole end.

20. A safety barrier system comprising:

a plurality of barrier assemblies, each barrier assembly including:

a barrier panel assembly having a rectangular barrier supported by an upper edge binding member, a lower edge binding member, a pair of left stiffeners and a pair of right stiffeners wherein the pair of left stiffeners capture a left edge of the rectangular barrier and the pair of right stiffeners capture a right edge of the rectangular barrier;

a barrier support pole including:

an upper pole end;

a lower pole end opposite the upper pole end, the lower pole end engageable with a ground insert for allowing rotation of the barrier support pole;

opposing first and second retention slots, each of the first and second retention slots extending from the upper pole end to the lower pole end, the first retention slot parallel to the second retention slot;

a top cap for engaging the upper pole end and securing at least one of the pair of left stiffeners or the pair of right stiffeners in one of the first or second retention slot;

a panel stop engaged with the first and second retention slot along a lower portion of the barrier support pole, the panel stop for supporting the lower edge binding member of the barrier panel assembly; and at least one post tie for securing two adjacent barrier support poles of the plurality of barrier support poles, the post tie comprising:

a first slot key and a second slot key, the first and second slot keys engageable with the opposing first and second retention slots;

a first securing tab securable to one of the first or second retention slots and a second securing tab securable to the other of the first or second retention slots; and tie openings disposed in the first and second securing tabs for securing the post tie to the two adjacent barrier support poles.

21. A kit for installing a safety barrier system, the kit including:

a plurality of barrier assemblies, each barrier assembly including:

a rectangular barrier supported by an upper edge binding member, a lower edge binding member, a pair of left stiffeners and a pair of right stiffeners wherein the pair of left stiffeners capture a left edge of the rectangular barrier and the pair of right stiffeners capture a right edge of the rectangular barrier;

a barrier support pole having a length, the barrier support pole including an upper pole end and a lower pole end opposite the upper pole end, the lower pole end engageable with a ground insert for allowing rotation of the barrier support pole and opposing first and second retention slots extending from the length of the barrier support pole;

a top cap for engaging the upper pole end and securing at least one of the pair of left stiffeners or the pair of right stiffeners in one of the first or second retention slot;

a panel stop engaged with the first and second retention slot along a lower portion of the barrier support pole, the panel stop for supporting the lower edge binding member of the barrier panel assembly;

an installation guide for guiding the pair or left stiffeners or the pair of right stiffeners into the corresponding first or second retention slot; and at least one post tie for securing two adjacent barrier support poles of the plurality of barrier support poles, the post tie comprising:

a first slot key and a second slot key, the first and second slot keys engageable with the opposing first and second retention slots;

a first securing tab securable to one of the first or second retention slots and a second securing tab securable to the other of the first or second retention slots; and tie openings disposed in the first and second securing tabs for securing the post tie to the two adjacent barrier support poles.

* * * * *